US008246377B2

(12) United States Patent
Lindkamp et al.

(10) Patent No.: US 8,246,377 B2
(45) Date of Patent: Aug. 21, 2012

(54) CONNECTOR HOUSING WITH INTEGRATED CABLE CLAMP

(75) Inventors: Marc Lindkamp, Luebbecke (DE); Andreas Kohler, Minden (DE)

(73) Assignee: Harting Electronics GmbH & Co. KG (DE)

( * ) Notice: Subject to any disclaimer, the term of this patent is extended or adjusted under 35 U.S.C. 154(b) by 157 days.

(21) Appl. No.: 12/868,031

(22) Filed: Aug. 25, 2010

(65) Prior Publication Data

US 2011/0065309 A1 Mar. 17, 2011

(30) Foreign Application Priority Data

Sep. 16, 2009 (DE) ..... 10 2009 041 868

(51) Int. Cl.
*H01R 13/58* (2006.01)

(52) U.S. Cl. ..... 439/461

(58) Field of Classification Search ..... 439/461, 439/462, 583, 584; 174/654, 653, 655; 285/322
See application file for complete search history.

(56) References Cited

U.S. PATENT DOCUMENTS

| | | | | |
|---|---|---|---|---|
| 2,523,741 | A * | 9/1950 | Weschler et al. | 248/56 |
| 3,861,778 | A | 1/1975 | Capra | 339/103 |
| 4,250,348 | A * | 2/1981 | Kitagawa | 174/655 |
| 6,284,973 | B1 | 9/2001 | Daoud | 174/65 |
| 6,488,317 | B1 * | 12/2002 | Daoud | 285/322 |
| 7,390,027 | B2 * | 6/2008 | Kiely | 285/151.1 |

FOREIGN PATENT DOCUMENTS

| | | |
|---|---|---|
| DE | 31 16 027 | 11/1982 |
| DE | 201 08 775 | 5/2001 |
| DE | 203 17 623 | 3/2005 |
| DE | 20 2006 006 313 | 7/2006 |
| EP | 1 037 325 | 3/2000 |

OTHER PUBLICATIONS

European Search Report issued in Appln. No. 10009316.1-1231, dated Dec. 2, 2010 (6 pgs).

German Examination Report issued in Appln. No. 10 2009 041 868.7-34 (2 pgs).

* cited by examiner

*Primary Examiner* — Phuong Dinh

(74) *Attorney, Agent, or Firm* — Hayes Soloway P.C.

(57) ABSTRACT

In a connector housing with integrated cable clamp, it is proposed to provide a receptacle sleeve for an electrical cable that is integrally formed on the connector housing and provided with clamping elements that are distributed over the radius and point in the mating direction. When a pressure screw is screwed onto the receptacle sleeve, the clamping elements are pressed radially inward and the electrical cable is clamped in position.

12 Claims, 3 Drawing Sheets

CONNECTOR HOUSING WITH INTEGRATED CABLE CLAMP

BACKGROUND OF THE INVENTION

1. Field of the Invention

The invention pertains to a device for clamping an electrical cable connected to a connector, wherein said device consists of a connector housing with an integral receptacle sleeve for the cable that is provided with a thread and at least one clamping element.

A device of this type is required for clamping a cable that is connected to contact elements of a connector and for fixing said cable in the connector housing. This serves for absorbing tensile loads on the cable of the connector and for the strain relief of the contact terminals of the connector, on which the cable is contacted.

2. Description of the Related Art

A few solutions for fixing cables on connectors are already known from the state of the art.

U.S. Pat. No. 6,284,973 discloses a strain relief device for a cable that consists of a base with a tubular extension. The tubular extension features a plurality of flexible arms that can be constricted by screwing on a nut with a conical region in its interior.

Another frequently utilized strain relief variation is the insertion of a crown spring for clamping the cable. In this case, a crown spring arranged on the cable is compressed when it is pressed into a conical sleeve on the connector end by means of a pressure screw and thusly holds the cable in the connector.

It is disadvantageous that the cable clamps of known clamping systems can only absorb low tensile loads because the clamping arms point in the direction of the tensile load and therefore cannot exert significant clamping forces upon the cable. In the latter variation, it is disadvantageous that turning of the crown spring and therefore the cable is unavoidable when the strain relief device is screwed down such that the conductors of the cable may become damaged.

SUMMARY OF THE INVENTION

The invention therefore is based on the objective of disclosing a device for clamping a cable on a connector that is able to accommodate cables with a broad variety of diameters, counteracts high tensile loads acting upon the cable and prevents the cable from turning.

This objective is attained in that the clamping element is arranged in a recess along the receptacle sleeve, in that the free end of the clamping element that points in the mating direction is separated on three sides, in that the surface of the clamping element that point radially outward features a thickening that forms a flattening, inclined surface toward the fixed end of the clamping element, and in that the clamping element is pressed radially inward and clamps the cable in position when a pressure screw is screwed onto the receptacle sleeve.

The invention concerns a device that is required for clamping a cable connected to a connector on a connector in order to thusly absorb high tensile loads acting upon the cable and to achieve a strain relief of the terminals in the connector.

The advantages attained with the invention can be seen, in particular, in that the rear side of a connector housing that faces away from the mating side is provided with a receptacle sleeve, into which a cable to be connected is inserted and clamped therein, preferably by means of several clamping elements. A pressure screw can be screwed onto the receptacle sleeve in order to actuate the clamping elements.

The receptacle sleeve is essentially realized in the form of an integral cylindrical element of the connector housing. The outside is provided with a thread for screwing on the pressure screw. Recesses in the form of openings that respectively accommodate the clamping elements are distributed over the circumference of the receptacle sleeve.

The clamping elements are integrally moulded into the recesses in the form of integral elements that are separated on three sides, wherein the end that faces the rear side of the connector housing is integrally moulded into the recess from inside.

On the side that points radially outward, the clamping elements feature a thickening that respectively protrudes over the outside thread diameter of the receptacle sleeve. The thickening is flattened toward the rear end of the clamping elements such that an inclined surface is created that transforms into the connection with the receptacle sleeve on its flat end.

In one preferred embodiment, four recesses with one respective clamping element are provided in the receptacle sleeve.

The pressure screw essentially consists of a component with the shape of a hollow cylinder that is provided with an internal thread in order to be screwed onto the receptacle sleeve. The rear side of the pressure screw is provided with an opening, through which the cable to be connected extends.

In one practical embodiment, the outer surface of the pressure screw is recessed or shaped such that the grip on the screw is improved or a tool can be attached.

According to the invention, the radially inner edge of the pressure screw that points in the mating direction presses against the inclined surface of the clamping elements when the pressure screw is screwed onto the receptacle sleeve. The thusly generated force results in a movement of the clamping element in the direction of the cable such that the free end moves radially inward about the fixed end and acts upon the cable situated in the receptacle sleeve.

In another practical embodiment, the inner ends of the clamping elements on the mating side are provided with additional means that allow a superior adhesion of the clamping elements on the cable.

According to an advantageous additional development, the clamping device also features a seal in order to prevent the admission of water and dirt.

According to another advantageous additional development, an inner sleeve is integrally formed within the receptacle sleeve and a tubular hollow body can be pushed onto the inner sleeve and fixed thereon.

BRIEF DESCRIPTION OF THE DRAWINGS

One embodiment of the invention is illustrated in the figures and described in greater detail below the figures show.

DESCRIPTION OF THE PREFERRED EMBODIMENTS

Figure 1:
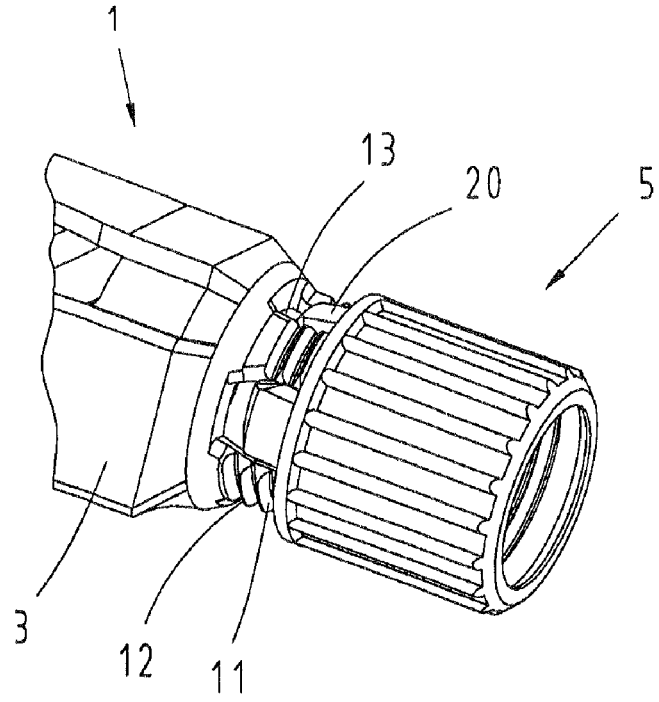
FIG. 1 a three-dimensional representation of a connector housing with a pressure screw partially screwed thereon, FIG. 2 a three-dimensional representation of a connector housing, FIG. 3 a connector housing in the form of a top view of the receptacle sleeve, FIG. 4 a connector housing with pressure screw in the form of a longitudinal section, FIG. 5 a connector housing with an inner sleeve integrally formed within the receptacle sleeve.

FIG. 1 shows a three-dimensional representation of a connector housing 1 with a pressure screw 5 partially screwed thereon. A contact area 3 that serves for accommodating contact elements is illustrated in the part of the connector housing 1 shown on the left side. In the region of the connector housing 1 illustrated on the right side, the connection area formed by an integral receptacle sleeve 10 follows the contact area 3.

The receptacle sleeve 10 serves for accommodating an electrical cable 2 that is inserted into the connector housing 1 and connected to the contact elements. The cylindrical receptacle sleeve 10 is provided with a thread 11, onto which a pressure screw 5 can be screwed. Recesses 13 are provided in and distributed over the circumference of the receptacle sleeve 10, wherein a clamping element 20 is respectively arranged in said recesses. In this case, the clamping elements 20 partially protrude radially beyond the outside diameter 12 of the thread 11 such that the pressure screw 5 exerts a force upon and presses the clamping elements 20 inward when it is screwed on further.

Figure 2:
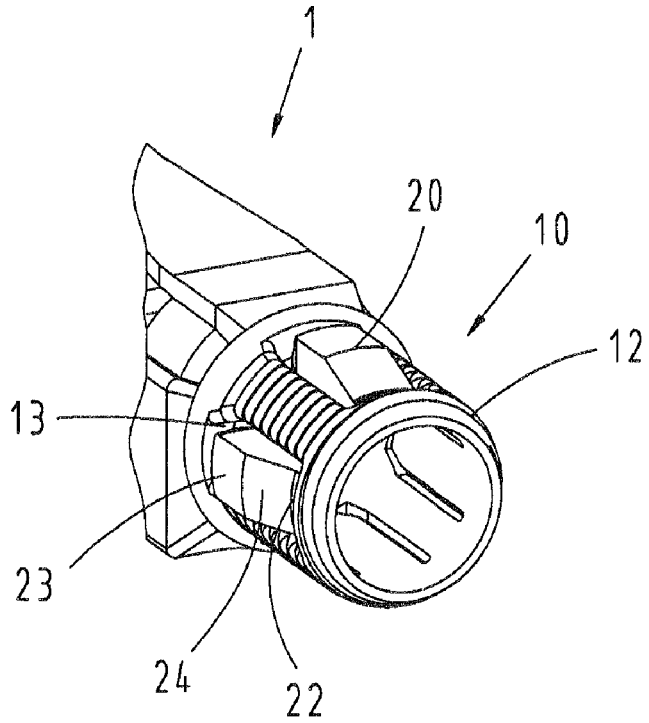

FIG. 2 shows a three-dimensional representation of an unmated connector housing 1 viewed in the direction of the receptacle sleeve 10. This figure shows four recesses 13 that are uniformly distributed over the circumference of the receptacle sleeve 10. One clamping element 20 is provided in each recess 13, wherein said clamping element is separated on three sides and fixed in the recess 13 opposite to the mating direction. The clamping elements 20 point radially outward and feature a thickening 23 that protrudes over the outside diameter 12 of the thread 11. The thickening 23 flattens toward the fixed end 22 and thusly forms an inclined surface 24 that is acted upon by the pressure screw 5 when it is screwed on.

Figure 3:
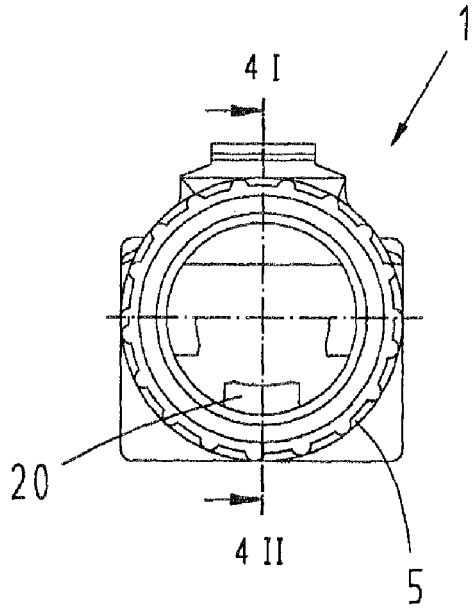

FIG. 3 shows a connector housing 1 in the form of a top view of the receptacle sleeve 10. In the initial state shown, the clamping elements 20 protrude into the interior of the connector. The line of section I, II for FIG. 4 is also illustrated in this figure.

Figure 4:
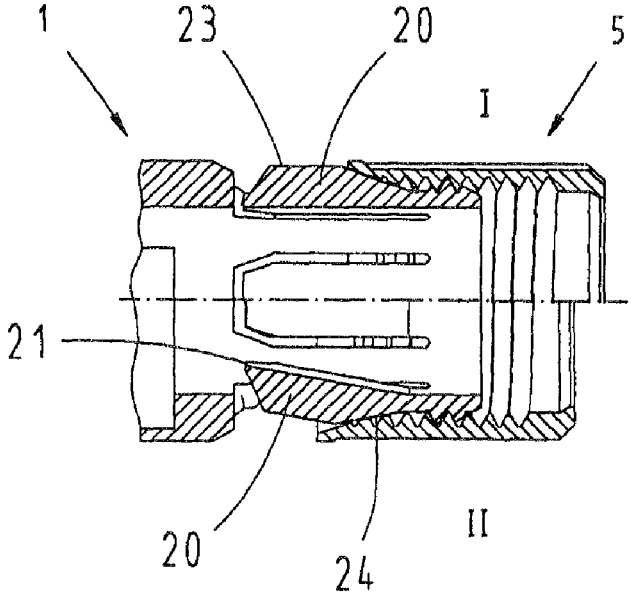

FIG. 4 shows a connector housing 1 with pressure screw 5 in the form of a section along the longitudinal axis, wherein the pressure screw 5 is only partially screwed onto the receptacle sleeve 10 in the upper region and the pressure screw 5 is completely screwed onto the receptacle sleeve 10 in the lower region. This figure shows how the pressure screw 5 adjoins the inclined surface 24 of the clamping elements 20 and exerts a force thereupon when it is screwed on. When the pressure screw is screwed on further, the free end 21 of the clamping element 20 moves radially inward and acts upon the electrical cable 2 situated in the receptacle sleeve 10.

Figure 5:
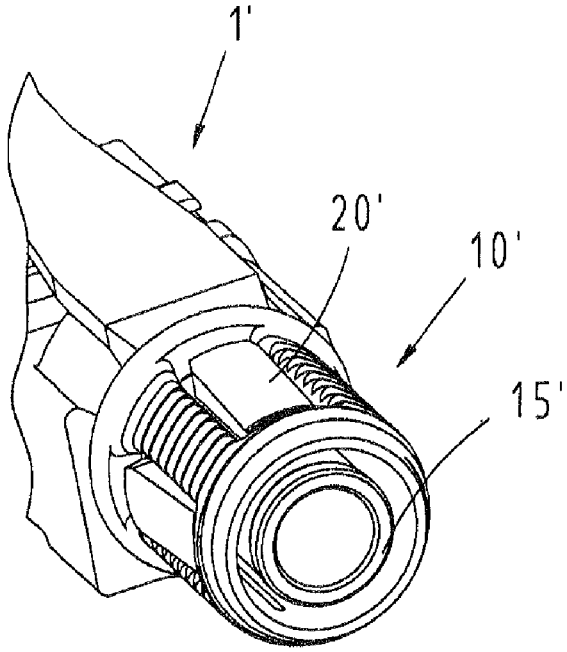
Figure 6:
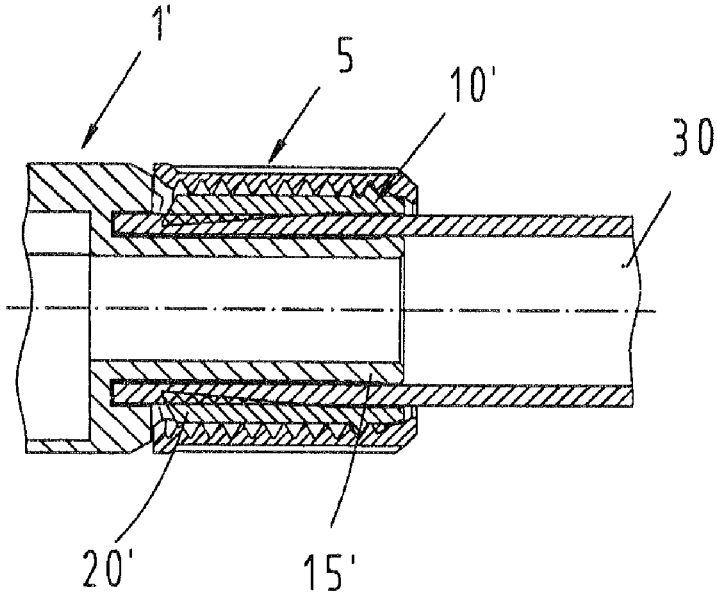
FIG. 6 is a sectional view of the connector housing of FIG. 5 with a pressure screw screwed thereon.

FIG. 5 shows a variation of a connector housing 1', in which an inner sleeve 15' is integrally formed within the receptacle sleeve 10' such that a force exerted upon the clamping elements 20' by the pressure screw 5 clamps a round, axially elongated hollow member 30 pushed onto the inner sleeve 15' in position as illustrated in the sectional representation according to FIG. 6.

What is claimed is:

1. A device for clamping an electrical cable that can be connected to a connector housing, consisting of a connector housing with an integral receptacle sleeve for the cable that is provided with a thread for accommodating a pressure screw and at least one clamping element having a free end and a fixed end, wherein the clamping element is arranged in a recess along the receptacle sleeve, wherein the free end of the clamping element that points in the mating direction is separated on three sides, wherein the surface of the clamping element that points radially outward features a thickening that forms a flattening, inclined surface toward the fixed end of the clamping element, and wherein the clamping element is pressed radially inward and clamps the cable in position when a pressure screw is screwed onto the receptacle sleeve.

2. The device according to claim 1, wherein the thickening on the clamping element radially protrudes over the outside diameter of the thread.

3. The device according to claim 1, wherein the inner side of the clamping element corresponds to the inner surface of the receptacle sleeve with respect to its shape and radius.

4. The device according to claim 1, wherein the clamping element has a wedge shape in order to fix the electrical cable.

5. The device according to claim 1, wherein the pressure screw features a thread that extends cylindrically over the entire length.

6. A device for clamping a round, axially elongated hollow member that can be connected to a connector housing, consisting of a connector housing with an integral receptacle sleeve that is provided with a thread for accommodating a pressure screw and at least one clamping element, wherein a cylindrical inner sleeve is integrally formed within the receptacle sleeve and the round hollow member can be pushed onto said cylindrical inner sleeve, and wherein the clamping element is pressed radially inward and clamps the hollow member on the inner sleeve when a pressure screw is screwed onto the receptacle sleeve.

7. The device according to claim 2, wherein the inner side of the clamping element corresponds to the inner surface of the receptacle sleeve with respect to its shape and radius.

8. The device according to claim 2, wherein the clamping element has a wedge shape in order to fix the electrical cable.

9. The device according to claim 3, wherein the clamping element has a wedge shape in order to fix the electrical cable.

10. The device according to claim 2, wherein the pressure screw features a thread that extends cylindrically over the entire length.

11. The device according to claim 3, wherein the pressure screw features a thread that extends cylindrically over the entire length.

12. The device according to claim 4, wherein the pressure screw features a thread that extends cylindrically over the entire length.

* * * * *